US009464613B2

(12) United States Patent
Ricco et al.

(10) Patent No.: US 9,464,613 B2
(45) **Date of Patent: *Oct. 11, 2016**

(54) FUEL INJECTOR EQUIPPED WITH A METERING SERVOVALVE FOR AN INTERNAL COMBUSTION ENGINE

(71) Applicant: C.R.F. SOCIETA CONSORTILE PER AZIONI, Orbassano (IT)

(72) Inventors: Mario Ricco, Casamassima (IT); Raffaele Ricco, Valenzano (IT); Sergio Stucchi, Valenzano (IT); Onofrio De Michele, Valenzano (IT)

(73) Assignee: C.R.F. SOCIETA CONSORTILE PER AZIONI (IT)

( * ) Notice: Subject to any disclaimer, the term of this patent is extended or adjusted under 35 U.S.C. 154(b) by 782 days.

This patent is subject to a terminal disclaimer.

(21) Appl. No.: 13/708,963

(22) Filed: Dec. 8, 2012

(65) Prior Publication Data

US 2014/0158797 A1 Jun. 12, 2014

Related U.S. Application Data

(63) Continuation of application No. 12/491,938, filed on Jun. 25, 2009, now Pat. No. 8,459,575.

(30) Foreign Application Priority Data

Jun. 27, 2008 (EP) ..... 08425460

(51) Int. Cl.
*F02M 63/00* (2006.01)
*F02M 47/02* (2006.01)

(52) U.S. Cl.
CPC ..... *F02M 63/0031* (2013.01); *F02M 47/027* (2013.01); *F02M 63/004* (2013.01);
(Continued)

(58) Field of Classification Search
CPC ..... F02M 63/004; F02M 63/0042; F02M 2200/16
USPC ..... 239/88, 96, 585.1–585.5; 251/129.06, 251/129.07, 129.16; 123/472, 490
See application file for complete search history.

(56) References Cited

U.S. PATENT DOCUMENTS

2003/0106533 A1 6/2003 Crofts et al.
2006/0102154 A1 5/2006 Ricco et al.
(Continued)

FOREIGN PATENT DOCUMENTS

DE 10218025 11/2003
DE 102006049885 4/2008
(Continued)

OTHER PUBLICATIONS

Search Report, EP.

*Primary Examiner* — Arthur O Hall
*Assistant Examiner* — Viet Le
(74) *Attorney, Agent, or Firm* — The Belles Group, P.C.

(57) ABSTRACT

A fuel injector has an injector body and a control rod, which is movable in the injector body along an axis to control the opening/closing of a nozzle that injects fuel into a cylinder of the engine; the injector body houses a metering servovalve having a control chamber, which is axially delimited by the control rod and communicates with an inlet and with a discharge channel; the metering servovalve is provided with a shutter, which slides axially on an axial guide, from which the discharge channel exits, to open and close the discharge channel and, in consequence, vary the pressure in the control chamber; the discharge channel has three restrictions having calibrated passage sections and arranged in series with each other to divide the pressure drop along the discharge channel.

15 Claims, 13 Drawing Sheets

(52) U.S. Cl.
CPC ..... *F02M63/007* (2013.01); *F02M 63/008* (2013.01); *F02M 63/0042* (2013.01); *F02M 2200/16* (2013.01); *F02M 2200/27* (2013.01); *F02M 2200/28* (2013.01); *F02M 2547/003* (2013.01)

(56) References Cited

U.S. PATENT DOCUMENTS

| | | | |
|---|---|---|---|
| 2006/0202144 | A1 | 9/2006 | Ricco et al. |
| 2006/0202145 | A1 | 9/2006 | Ricco et al. |
| 2006/0231077 | A1 | 10/2006 | Ricco et al. |
| 2006/0266846 | A1 | 11/2006 | Ricco et al. |
| 2007/0205302 | A1 | 9/2007 | Ricco et al. |

FOREIGN PATENT DOCUMENTS

| | | | |
|---|---|---|---|
| DE | 102006050810 | | 4/2008 |
| DE | 102006050812 | | 4/2008 |
| DE | 102006057935 | | 6/2008 |
| EP | 1612403 | | 1/2006 |
| EP | 1916411 | | 4/2008 |
| EP | 1916411 | A2 * | 4/2008 |
| WO | WO03071122 | | 8/2003 |
| WO | WO2005080785 | | 9/2005 |

* cited by examiner

FUEL INJECTOR EQUIPPED WITH A METERING SERVOVALVE FOR AN INTERNAL COMBUSTION ENGINE

CROSS-REFERENCE TO RELATED APPLICATIONS

The present patent application is a continuation of U.S. patent application Ser. No. 12/491,938, filed Jun. 25, 2009, which in turn claims priority under 35 U.S.C. §119 to European Patent Application No. 08425460.6, filed Jun. 27, 2008, the entireties of which are hereby incorporated by reference.

FIELD OF THE INVENTION

The present invention concerns a fuel injector equipped with a metering servovalve for an internal combustion engine.

BACKGROUND OF THE INVENTION

Usually, injectors for internal combustion engines comprise a metering servovalve having a control chamber, which communicates with a fuel inlet and with a fuel discharge channel. The metering servovalve comprises a shutter, which is axially movable under the action of an electro-actuator to open/close an outlet opening of the discharge channel and vary the pressure in the control chamber. The pressure in the control chamber, in turn, controls the opening/closing of an end nozzle of the injector to supply the fuel in a associated cylinder.

The discharge channel has a calibrated segment, which is of particular importance for correct operation of the metering servovalve. In particular, in this calibrated segment, a fluid flow rate is associated with a predefined pressure differential.

In the injectors that are produced, the calibrated segment of the discharge channel is produced by making a perforation via electron discharge machining, followed by a finishing operation, necessary to eliminate any perforation defects that, even if small, would in any case result in large pressure drop errors in the flow of fuel and, consequently, in the flow rate of fuel leaving the control chamber.

In particular, the finishing operation is of an experimental nature and is carried out by making an abrasive liquid flow through the hole made via electron discharge machining, setting the pressure upstream and downstream of the hole and detecting the flow rate: the flow rate tends to increase progressively with the abrasion caused by the liquid on the lateral surface of the hole, until a preset design value is reached. At this point, the flow is interrupted: in usage, the section of the final passage obtained shall determine, with close approximation, a pressure drop equal to the difference in pressure established upstream and downstream of the hole during the finishing operation and a flow rate of fuel leaving the control chamber equal to the preset design value.

In the injector disclosed in patent EP1612403, the discharge channel has an outlet made in an axial stem guiding the shutter, which is defined by a sliding sleeve. The calibrated segment of the discharge channel is coaxial with the axial stem and is made in a perforated plate, which axially delimits the control chamber. Downstream of this calibrated segment, the discharge channel comprises an axial segment and then two opposed radial sections, which define, together, a relatively large passage section for the discharged fuel. Considering, for example, a fuel supply pressure of approximately 1600 bar to the injector, when the metering servovalve is open, or rather when the sleeve that defines the shutter is raised in the open position, the fuel inlet that runs into the control chamber determines a pressure drop down to approximately 700 bar in the control chamber; then, between the upstream and downstream ends of the calibrated segment of the discharge channel, the fuel pressure drops from approximately 700 bar to a few bar.

The curve shown with a line in FIG. 16 is an experimental curve that qualitatively shows the pressure trend of the fuel flow leaving the control chamber when the servovalve is open. A pressure $P_1$ (approximately equal to 700 bar, as indicated above) is present in the control chamber, while in the discharge environment, downstream of the seal between the axial stem and the sleeve that defines the shutter, pressure $P_{SCAR}$ is present. The linearized distance with respect to the control chamber is shown on the abscissa. In particular:

- $X_A$: position immediately next to the outlet of the calibrated segment,
- $X_{RAD}$: inlet position on the two opposed radial sections,
- $X_{TEN}$: position at the sealing zone between the axial stem and the sleeve that defines the shutter,
- $X_{SCA}$: position in the discharge environment in which the fuel pressure stabilizes itself.

Experimentally, due to the large pressure drop, the onset of cavitation is encountered. In other words, the fuel pressure upstream of the discharge environment drops below the vapour pressure, indicated as $P_{VAPOR}$, in correspondence to the outlet from the calibrated segment, where fuel flow velocity is maximum and the pressure is minimum ($P_{MIN}$). In particular, the fraction or percentage of vapour is close to one.

As the passage sections from position $X_A$ to position $X_{TEN}$ are relatively narrow (even if larger than that of the calibrated segment), the fuel pressure slowly rises, and not all of the vapour that formed immediately downstream of position $X_A$ returns to the liquid state.

Thus, in correspondence to position $X_{TEN}$ the vapour fraction is still substantial. In correspondence to position $X_{TEN}$, there is then the maximum increase in passage section. In this zone, it is possible to distinguish three undesired phenomena:

- due to the rapid increase in passage section, the pressure tends to rise and the previously formed vapour bubbles tend to implode; when this phenomenon takes place next to the surfaces that define the seal, it causes undesired wear on these surfaces,
- during closure of the shutter, contact between the surfaces that define the seal takes place in the presence of vapour, namely in "dry" conditions, with consequent impacts that cause further wear, and
- in addition, always due to these "dry" conditions, the damping effect of the liquid is lost and shutter rebound occurs, which causes a delay in closing the servovalve, with a consequent undesired increase in the amount of injected fuel with respect to that established by design.

Summarizing: the wear deriving from the above-stated phenomena greatly reduces injector life, while the rebounds in the closure phase make the injector inaccurate.

Moreover, to generate a pressure drop of approximately 700 bar, the calibrated segment must have an extremely small diameter, which is extremely complex to make with precision and in a constant manner across the various injectors.

The same drawbacks are present in the embodiment disclosed in the US patent application having publication number US2003/0106533, as the discharge channel substantially has the same arrangement with two opposed radial outlet segments which define, together, a relatively large passage section. Unlike the embodiment disclosed in EP1612403, the discharge channel is made in the shutter, which is defined by a axially sliding pin.

SUMMARY OF THE INVENTION

The object of the present invention is that of embodying a fuel injector equipped with a metering servovalve for an internal combustion engine, which enables the above-stated problems to be resolved in a simple and economic manner, limiting as much as possible the risks of the presence of vapour around the sealing zone between the shutter and the axial stem.

According to the present invention, a fuel injector for an internal combustion engine is provided; the injector ending with a nozzle to inject fuel into an associated engine cylinder and comprising:

a hollow injector body extending along an axial direction;

a metering servovalve housed in said injector body and comprising:

a) an electro-actuator;

b) a control chamber communicating with a fuel inlet and with a fuel discharge channel; the pressure in said control chamber controlling the opening/closing of said nozzle;

c) a shutter axially movable in response to the action of said electro-actuator between a closed position, in which an outlet of said discharge channel is closed, and an open position, in which the discharge channel is open to vary the pressure in said control chamber;

characterized in that the said discharge channel comprises three restrictions having calibrated passage sections and arranged in series with each other so as to cause respective pressure drops when said discharge channel is open.

BRIEF DESCRIPTION OF THE DRAWINGS

For a better understanding of the present invention, a preferred embodiment will now be described, purely by way of a non-limitative example, with reference to the attached drawings, in which.

DETAILED DESCRIPTION OF THE DRAWINGS

Figure 1:
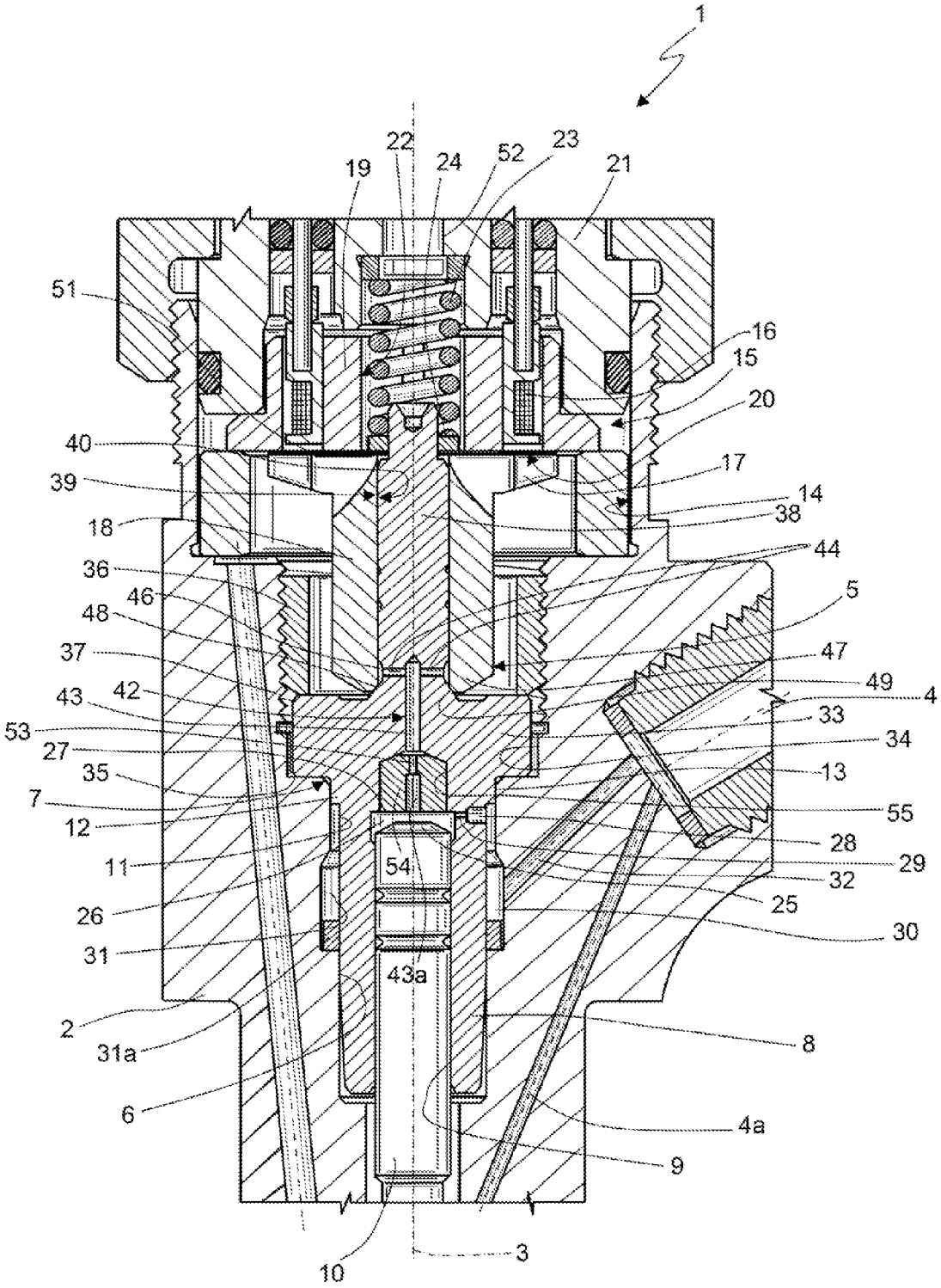
FIG. 1 shows, in cross-section and with parts removed, a fuel injector which is equipped with a metering servovalve for an internal combustion engine and is not part of the present invention.

With reference to FIG. 1, numeral 1 indicates, as a whole, a fuel injector (partially shown) for an internal combustion engine, in particular with a diesel cycle. The injector 1 comprises a hollow body or casing 2, commonly known as the "injector body", which extends along a longitudinal axis 3, and has a lateral, inlet 4 suitable for connection to a high-pressure fuel supply line, at a pressure of around 1600 bar for example. The casing 2 ends with an injection nozzle (not shown in the figure), which is in communication with the inlet 4 through a channel 4*a*, and is able to inject fuel into an associated engine cylinder.

The casing 2 defines an axial cavity 6 in which a metering servovalve 5 is housed, comprising a valve body, made in a single piece and indicated with reference numeral 7.

The valve body 7 comprises a tubular portion 8 defining a blind axial hole 9 and a centring ridge 12, which radially projects with respect to a cylindrical outer surface of the portion 8 and couples with an inner surface 13 of the body 2.

A control rod 10 axially slides in a fluid-tight manner in the hole 9 to control, in a known and not shown manner, a shutter needle that opens and closes the injection nozzle.

The casing 2 defines another cavity 14 coaxial with the cavity 6 and housing an actuator 15, which comprises an electromagnet 16 and a notched-disc anchor 17 operated by the electromagnet 16. The anchor 16 is made in a single piece with a sleeve 18, which extends along the axis 3. Instead, the electromagnet 16 comprises a magnetic core 19, which has a surface 20 perpendicular to the axis 3 and defines an axial stop for the anchor 17, and is held in position by a support 21.

The actuator 15 has an axial cavity 22 housing a coil compression spring 23, which is preloaded to exert thrust on the anchor 17 in the opposite axial direction to the attraction exerted by the electromagnet 16. The spring 23 has one end resting against an internal shoulder of the support 21, and the other end acting on the anchor 17 through a washer 24 inserted axially between them.

The metering servovalve 5 comprises a control chamber 26 delimited radially by the lateral surface of the hole 9 of the tubular portion 8. The control chamber 26 is axially delimited on one side by an end surface 25 of the rod 10, usefully having a truncated-cone shape, and by a bottom surface 27 of the hole 9 on the other.

The control chamber 26 is in permanent communication with the inlet 4 through a channel 28 made in portion 8 to receive pressurized fuel. The channel 28 comprises a calibrated segment 29 running on one side to the control chamber 26 in proximity to the bottom surface 27 and on the other to an annular chamber 30, radially delimited by the surface 11 of portion 8 and by an annular groove 31 on the inner surface of the cavity 6. The annular chamber 30 is axially delimited on one side by the ridge 12 and on the other by a gasket 31*a*. A channel 32 is made in the body 2, is in communication with the inlet 4 and exits into the annular chamber 30.

The valve body 7 comprises an intermediate axial portion defining an external flange 33, which projects radially with respect to the ridge 12, and is housed in a portion 34 of the cavity 6 with enlarged diameter and arranged axially in contact with a shoulder 35 inside the cavity 6. The flange 33 is tightened against the shoulder 35 by a threaded ring nut 36, screwed into an internal thread 37 of portion 34, in order to guarantee fluid-tight sealing against the shoulder 35.

The valve body 7 also comprises a guide element for the anchor 17 and the sleeve 18. This element is defined by a substantially cylindrical stem 38 having a much smaller diameter than that of the flange 33. The stem 38 projects beyond the flange 33, along the axis 3 in the opposite direction to the tubular portion 8, namely towards the cavity 22. The stem 38 is externally delimited by a lateral surface 39, which comprises a cylindrical portion guiding the axial sliding of the sleeve 18. In particular, the sleeve 18 has an internal cylindrical surface 40, coupled to the lateral surface 39 of the stem 38 that is substantially fluid-tight, or rather via a coupling with opportune diameter play, 4 micron for example, or via the insertion of specific sealing elements.

The control chamber 26 is in permanent communication with a fuel discharge channel, indicated as a whole by reference numeral 42.

The channel 42 comprises a blind axial segment 43, made along the axis 3 in the valve body 7 (partly in the flange 33 and partly in the stem 38). The channel 42 also comprises at least one outlet segment 44, which is radial, begins from the segment 43 and defines, at the opposite end, an outlet opening onto lateral surface 39, at a chamber 46 defined by an annular groove made in the lateral surface 39 of the stem 38.

Figure 2:
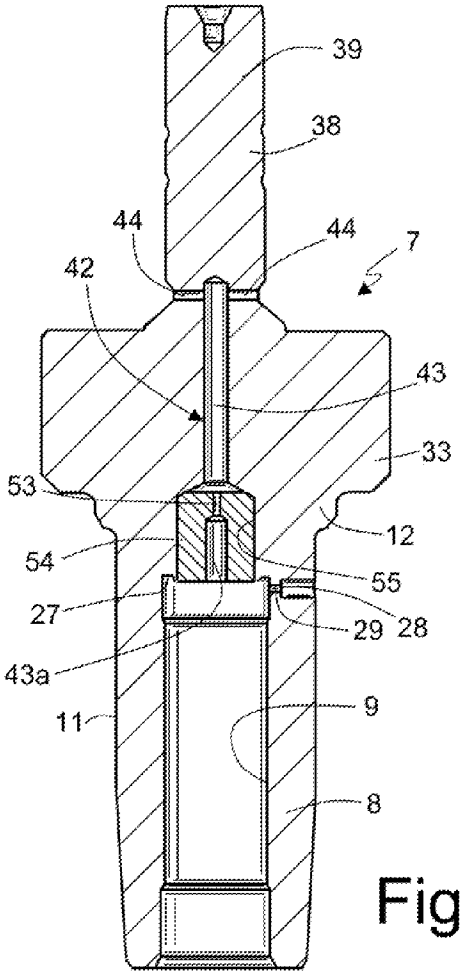
FIG. 2 shows a detail of FIG. 1 on a larger scale.

In particular, in the embodiment of FIGS. 1 and 2, two sections 44 are provided that are diametrically opposed to each other.

The chamber 46 is obtained in an axial position next to the flange 33 and is opened/closed by an end portion of the sleeve 18, which defines a shutter 47 for the channel 42. In particular, the shutter 47 ends with a truncated-cone inner surface 48, which is able to engage a truncated-cone connecting surface 49 between the flange 33 and the stem 38 to define a sealing zone.

The sleeve 18 slides on the stem 38, together with the anchor 17, between an advanced end stop position and a retracted end stop position. In the advanced end stop position, the shutter 47 closes the annular chamber 46 and thus the outlet of the sections 44 of the channel 42. In the retracted end stop position, the shutter 47 sufficiently opens the chamber 46 to allow the sections 44 to discharge fuel from the control chamber 26 through the channel 42 and the chamber 46. The passage section left open by the shutter 47 has a truncated-cone shape and is at least three times larger that the passage section of a single segment 44.

The advanced end stop position of the sleeve 18 is defined by the surface 48 of the shutter 47 hitting against the truncated-cone connection surface 49 between the flange 33 and the stem 38. Instead, the retracted end stop position of the sleeve 18 is defined by the anchor 17 axially hitting against the surface 20 of the core 19, with a nonmagnetic gap sheet 51 inserted in between. In the retracted end stop position, the chamber 46 is placed in communication with a discharge channel of the injector (not shown), via an annular passage between the ring nut 36 and the sleeve, the notches in the anchor 17, the cavity 22 and an opening 52 on the support 21.

When the electromagnet 16 is energized, the anchor 17 moves towards the core 19, together with the sleeve 18, and hence the shutter 47 opens the chamber 46. The fuel is then discharged from the control chamber 26: in this way, the fuel pressure in the control chamber 26 drops, causing an axial movement of the rod 10 towards the bottom surface 27 and thus the opening of the injection nozzle.

Conversely, on de-energizing the electromagnet 16, the spring 23 moves the anchor 17, together with the shutter 47, to the advanced end stop position in FIG. 1. In this way, the chamber 46 is closed and the pressurized fuel entering from the channel 28 re-establishes high pressure in the control chamber 26, resulting in the rod 10 moving away from the bottom surface 27 and operating the closure of the injection nozzle. In the advanced end stop position, the fuel exerts a substantially null axial thrust resultant on the sleeve 18, as the pressure in the chamber 46 only acts radially on the lateral surface 40 of the sleeve 18.

In order to control the velocity of pressure variation in the control chamber 26 on the opening and closing the shutter 47, the channel 42 comprises calibrated restrictions. The term "restriction" is intended as a channel portion in which the passage section globally available for the fuel is smaller than the passage section that the fuel flow encounters upstream and downstream of this channel portion. In particular, if the fuel flows in a single hole, the restriction is defined by said single hole; on the other hand, if the fuel flows in a plurality of holes which are located in parallel and, therefore, are subjected to the same pressure drop between upstream and downstream, the restriction is defined by the entirety of said holes.

Instead, the term "calibrated" is intended as the fact that the passage section is made with precision in order to accurately define a predetermined fuel flow rate from the control chamber 26 and to cause a predetermined pressure drop from upstream to downstream.

In particular, for holes having relatively small, diameters, calibration is achieved in a precise manner via a finishing operation of an experimental nature, which is carried out by making an abrasive liquid run through the previously made hole (for example, by electron discharge or laser), setting a pressure upstream and downstream of this and reading the flow rate passing through: the flow rate tends to progressively increase with the abrasion caused by the liquid on the lateral surface of the hole (hydro-erosion or hydro-abrasion), until a pre-established design value is reached. At this point, the flow is interrupted: in use, having a pressure upstream of the hole equal to that established during the finishing operation, the final passage section that is obtained defines a pressure drop equal to the difference in pressure established upstream and downstream of the hole during the finishing operation and a fuel flow rate equal to the preset design flow rate.

For example, the restrictions of the channel 42 have a diameter between 150 and 300 micron, while segment 43 of the channel 42 is obtained in the valve body 7 via a normal drilling bit, without special precision, to achieve a diameter that is at least four times greater than the diameter of the calibrated restrictions.

There are at least two restrictions and they are arranged in series with each other along the channel 42 (in the attached figures, the diameter of the restrictions is only shown for completeness and is not in scale), so as to cause respective consequent pressure drops when the shutter is located in its retracted end stop position, as it will be better described later on. Obviously, between two consequent restrictions, the channel 42 comprises an enlarged intermediate segment, i.e. with a passage section larger that those of both the restrictions.

In the embodiment of FIGS. 1 and 2, one of the calibrated restrictions is defined by the combination of the two sections 44, while the other is indicated by reference numeral 53 and is made in a separate element from the valve body 7 and subsequently fixed in correspondence to the bottom surface 27 of the hole 9. In particular, the calibrated restriction 53 is arranged in a cylindrical bushing 54 made of a relatively hard material, defining an insert housed in a seat 55 of the valve body 7 and arranged flush with the bottom surface 27. The bushing 54 has an external diameter such as to allow insertion and fixing in the seat 55 by interference fitting, after the above-described finishing operation.

The calibrated restriction 53 axially extends for only part of the length of the bushing 54 and is in a position adjacent to segment 43, while the remainder of the bushing 54 has an axial segment 43*a* of larger diameter, for example, equal to that of segment 43 in the valve body 7. The volume of segment 43*a* is added to that defined by the bottom of the hole 9 to define the volume of the control chamber 26. Depending on the optimal volume required for the control chamber 26, the bushing 54 can be inverted so as to have the calibrated restriction 53 running directly into the bottom of the hole 9, as in the variants in FIGS. 7 and 8.

According to a variant that is not shown, the calibrated restriction 53 can also be arranged in an intermediate axial position along the bushing 54.

Figure 3:
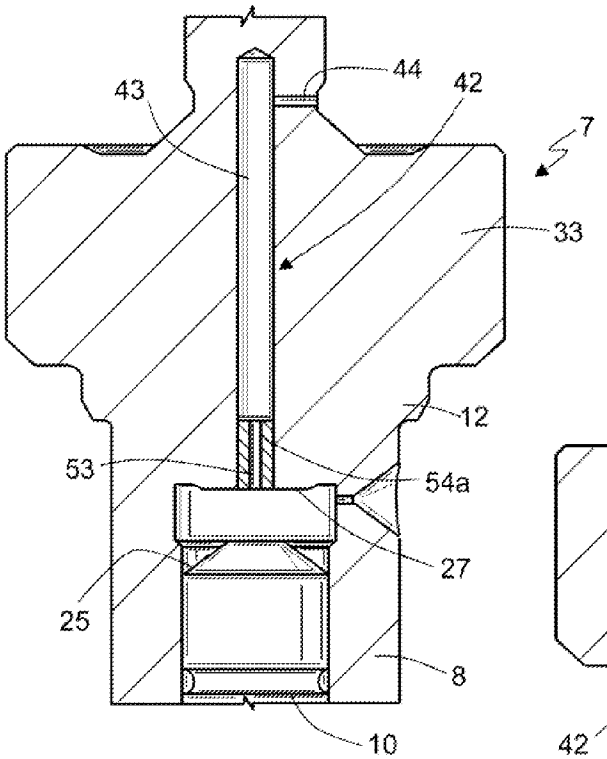
FIG. 3 is similar to FIG. 2 and shows a variant of the embodiment of FIG. 1 on an even larger scale.

According to the variant in FIG. 3, a single segment 44 with a calibrated passage section is provided. In particular, this passage section is equal to the sum of the passage sections of the sections 44 of the embodiment of FIGS. 1 and 2. Furthermore, the calibrated restriction 53 is obtained in a bushing 54*a* over its entire axial length. The bushing 54*a* has an external diameter substantially corresponding to that of the segment 43, and in driven into this segment 43 so that its lower surface is flush with the bottom surface 27 of the hole 9.

Figure 4:
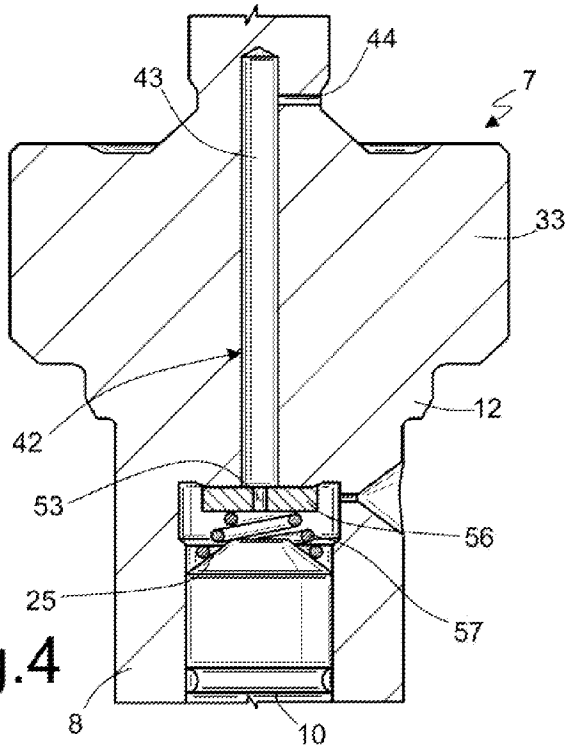
FIGS. 4 to 9 are similar to FIG. 3 and respectively show variants of the embodiment of FIG. 1.

According to the variant in FIG. 4, the calibrated restriction 53 is obtained axially on a plate 56 arranged in the control chamber and resting axially against the valve body 7. Since the travel of the rod 10 to open and close the nozzle of the injector 1 is relatively small, the plate 56 can be kept in contact with the bottom surface 27 via a compression spring 57 inserted between the plate 56 and the end surface 25 of the rod 10. The truncated-cone shape of the end surface 25 performs the function of centring the compression spring 57. Preferably, the plate 56 has a smaller diameter than that of the hole 9, while the compression spring 57 has a truncated-cone shape.

According to a variant that is not shown, the hole 9 comprises a bottom portion with a diameter corresponding to the external diameter of the plate 56: in this case, the plate 56 could be fixed in this bottom portion by interference fitting.

Figure 6:
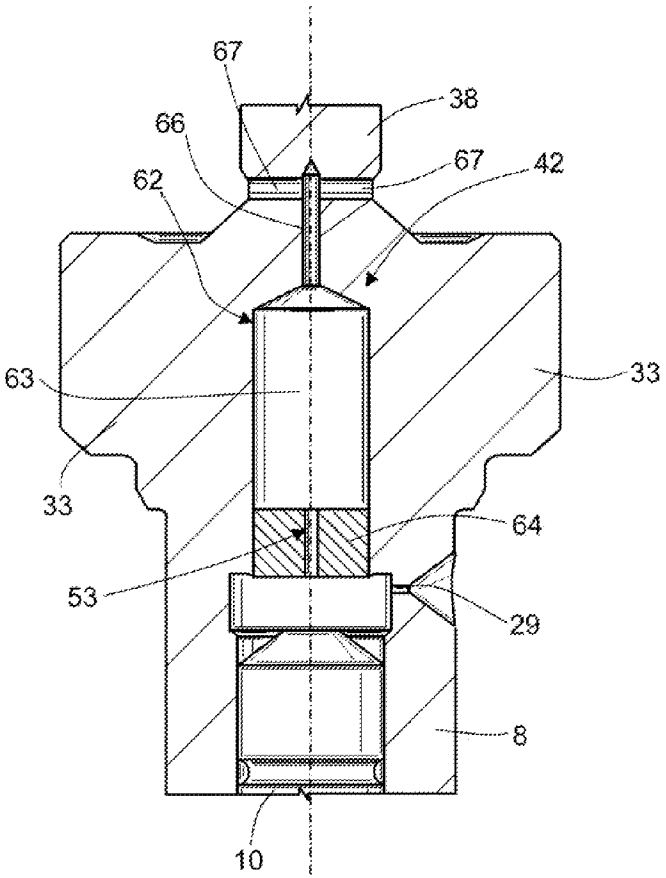
Figure 5:
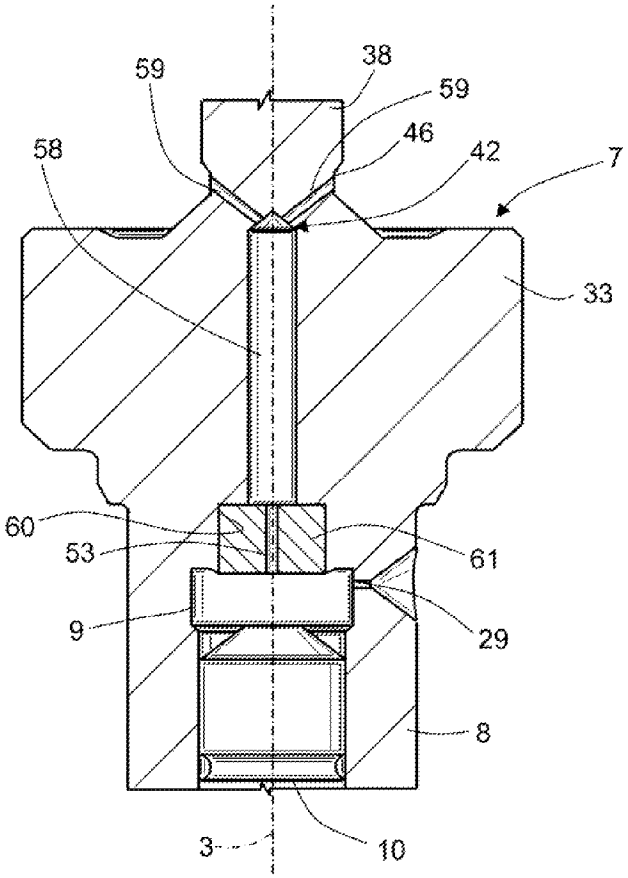

According to the variants in FIGS. 5 and 6, the channel 42 has an axial hole of relatively large diameter, obtained in the flange 33, to facilitate manufacturing. According to the variant in FIG. 5, this axial hole of relatively large diameter is indicated by reference numeral 58 and axially ends in correspondence to a zone of connection between the stem 38 and the flange 33. Instead of the sections 44, the channel 42 comprises two diametrically opposed holes 59, which define a calibrated restriction and are inclined by a certain angle with respect to the axis 3 in order to place the chamber 46 in direct communication with the bottom of the hole 58. Preferably, the angle of inclination with respect to the axis 3 is between 30° and 45'.

By ensuring that the hole 58 is completely within the flange 33 of the valve body 7, the stem 38 proves to be more robust compared to the embodiment of FIGS. 1 and 2. In consequence, the diameter of the stem 38, and therefore the diameter of the annular sealing zone between the sleeve 18 and the stem 38 can be reduced, with obvious benefits in limiting leaks in this seal under dynamic conditions. In particular, with this solution, the diameter of the sealing zone can now be decreased to a value between 2.5 and 3.5 mm without the stem 38 being structurally weak.

Furthermore, by reducing the axial length and enlarging the diameter of the hole 58 with respect to the segment 43, the making of the hole 58 and subsequent cleaning out of chips are facilitated. The hole 58 usefully has a diameter between 8 and 20 times that of the calibrated restriction 53. In this way, when making the holes 59, the intersection of the holes 59 with the bottom of the hole 58 is facilitated.

The calibrated restriction 53 is obtained in a cylindrical bushing 61 and extends for the entire length of the bushing 61. The bushing 61 is driven, or rather inserted by force, into an axial seat 60 after the hole 58 has been cleaned. The seat 60 has a larger diameter than that of the hole 58 and a shorter length than that of the hole 58, which facilitates press fitting; the bushing 61 could have a small, conical, external chamfer (not shown) on the side fitting into the flange 33 to facilitate its axial insertion into the seat 60.

According to the variant in FIG. 6, the axial hole of relatively larger diameter is indicated by reference numeral 63 and defines the initial segment of a blind axial hole 62. The inlet of the segment 63 houses a bushing 64 inserted by force and having the calibrated restriction 53, which extends for the entire axial length of the bushing 64. Similar to bushing 61, bushing 64 could have a small, external, conical chamfer (not shown) on the side fitting into the flange 33.

The hole 62 also comprises a blind segment 66 having a smaller diameter than that of segment 63, extending beyond the flange 33 into the stem 38 and defining a calibrated restriction. The diameter of segment 66 is greater than that of the calibrated restriction 53: for example, it is approximately two times that of the calibrated restriction 53. Notwithstanding the greater diameter, it is possible to obtain a pressure drop of the same order of magnitude of that caused by restriction 53, by calibrating in an appropriate way the length of the segment 66.

Since the diameter of segment 66 is still relatively small, the diameter of the stem 38 and thus the diameter of the seal with the sleeve 18 can be reduced with respect to the solution in FIGS. 1 and 2. Also in this configuration, the diameter of the sealing zone can be usefully decreased to a value between 2.5 and 3.5 mm, depending on the materials chosen and the type of heat treatment adopted.

The channel 42 also comprises two diametrically opposed radial sections 67, which are made so as to define a larger passage section than that of segment 66 and without special machining precision. The sections 67 run directly to the calibrated segment 66 on one side and to the chamber 46 on the other.

According to variants of FIGS. 5 and 6 that are not shown, the bushings 61 and 64 are substituted by bushings similar to that indicated by reference numeral 54 in FIG. 1.

Figure 8:
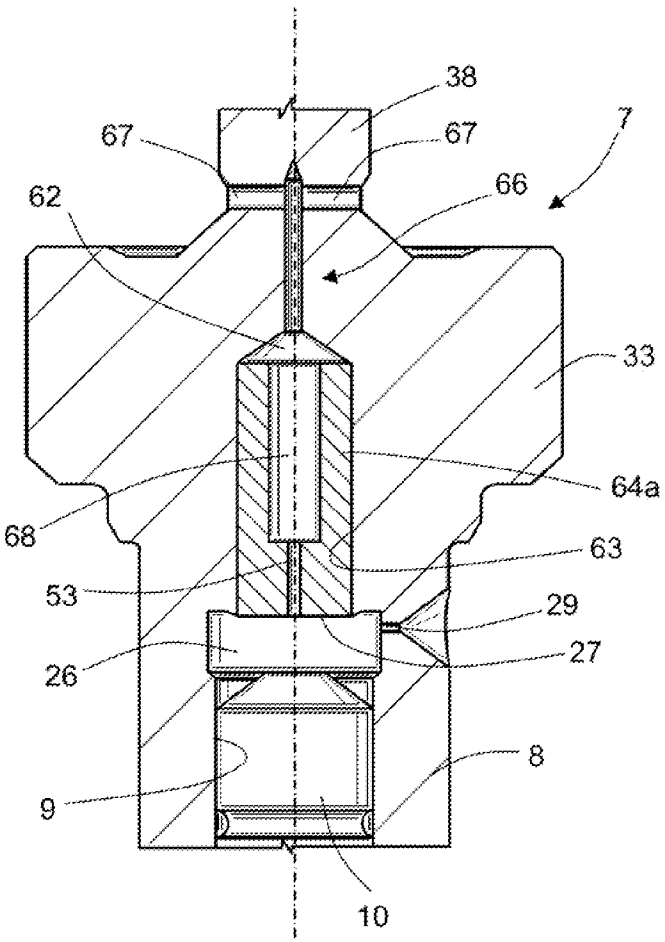
Figure 7:
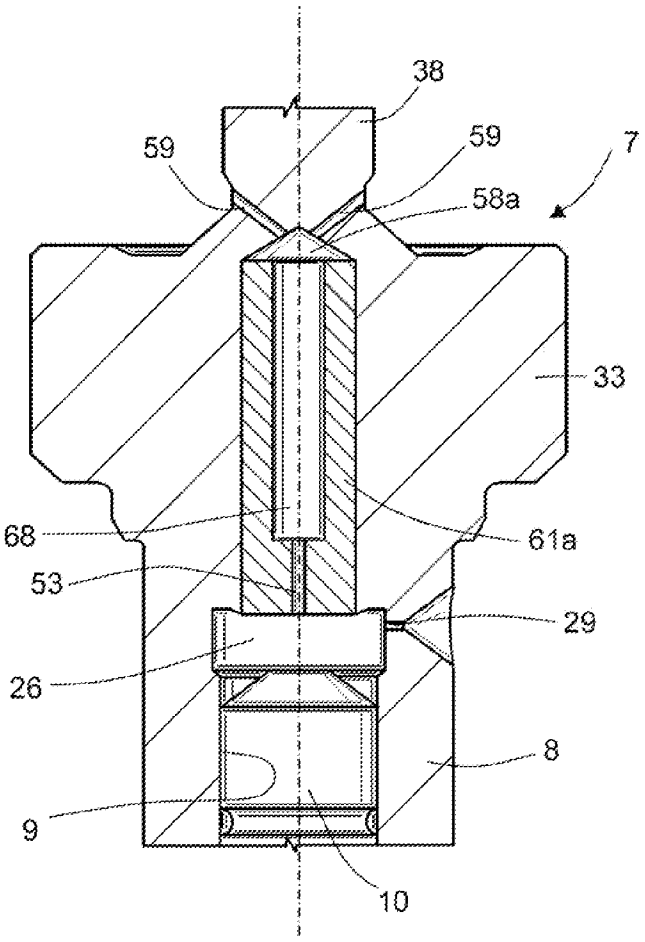

The variants in FIGS. 7 and 8 differ from those in FIGS. 5 and 6 due to the fact that the calibrated restriction 53 is obtained in a bushing, 61*a* and 64*a* respectively, and that it extends for a relatively small part of the axial length of the bushing 61*a* and 64*a*. The calibrated restriction 53 is adjacent to the bottom surface 27, and so the volume of the control chamber 26 is exclusively defined by the volume at the bottom of the hole 9.

The remaining part of the bushing 61*a* and 64*a* has an axial hole 68 made with a larger diameter than the calibrated restriction 53 without special machining precision.

In the variant in FIG. 7, the hole 58 and the seat 60 are substituted by a blind axial hole 58*a*, which is made entirely within the flange 33 like hole 58 in FIG. 6, but defines a cylindrical seat completely engaged by the bushing 61*a*. Similarly, in the variant in FIG. 8, the segment 63 is completely engaged by the bushing 64*a*.

In the variants in FIG. 7 and FIG. 8, the bushing 61*a* and 64*a* is respectively press-fitted into hole 58*a* and segment 63, until it stops against a respective conical end narrowing of the hole 58*a* and the segment 63.

Figure 9:
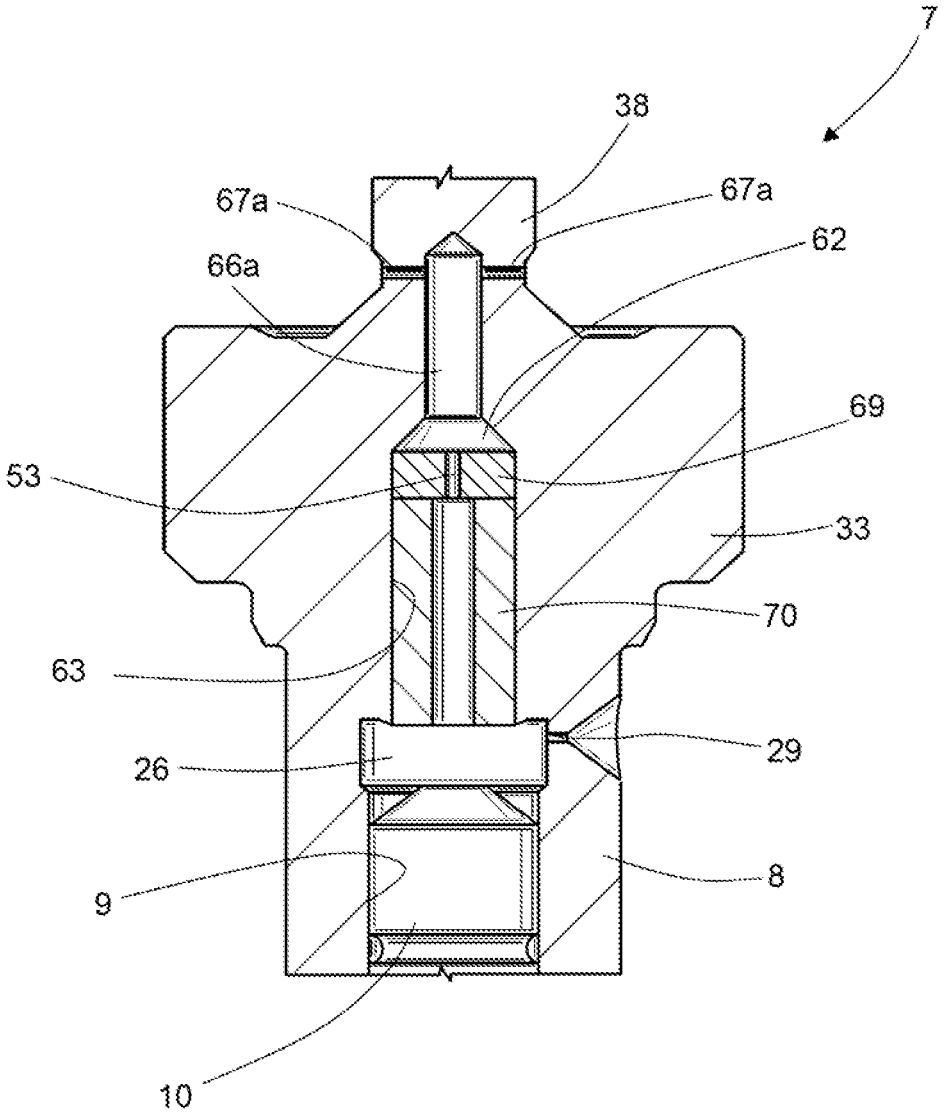

In the variant in FIG. 9, with respect to that in FIG. 8, sections 67 are substituted by sections 67*a* defining a calibrated restriction, segment 66 is substituted by a segment 66*a* made without special precision and having a larger passage section than that of sections 67*a*, and the calibrated restriction 53 is made on a relatively thin plate 69 made of a relatively hard material and housed at the bottom of segment 63.

The plate 69 defines a through hole, the volume of which forms part of the control chamber 26, and is not interference fitted, but axially secured to the bottom of segment 63 by an insert defined by a sleeve 70, which is interference fitted to the inlet of segment 63 and is made of a relatively soft material to facilitate press fitting.

Figure 10:
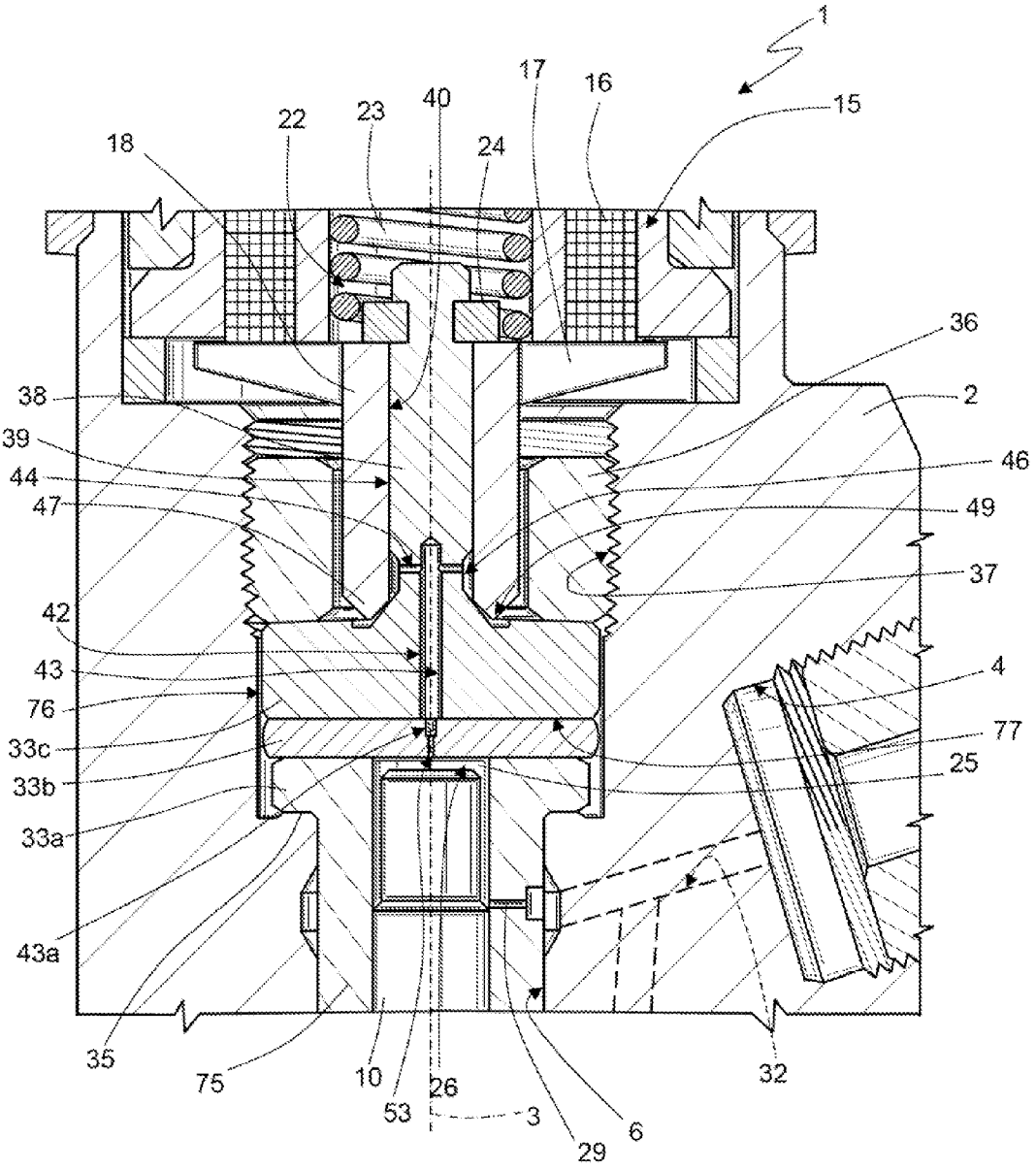
FIG. 10 is similar to FIG. 1 and, on an enlarged scale, shows another injector, which is not part of the present invention.

In the embodiment of FIG. 10, where possible, the components of the injector 1 are indicated by the same reference numerals used in FIG. 1. In this embodiment, the valve body 7 is substituted by three distinct pieces: a tubular body 75 (partially shown), radially delimiting the control chamber 26 and ending with an external flange 33*a* arranged in axial contact with the shoulder 35, a disc 33*b*, axially delimiting the control chamber 26 on the opposite part from the end surface 25 and arranged in axial contact with the end of the body 75, and a distribution and guide body 76, which is made as a single piece and comprises the stem 38 and a base defining an external flange 33*c*. The flange 33*c* is axially secured via the ring nut 36 and is axially delimited by a surface 77, which is arranged in axial contact with the disc 33*b*, in a fluid-tight and fixed position.

The stem 38 projects axially from the base 33*c* in the opposite direction to the disc 33*b* and comprises the calibrated restriction defined by the holes 44. The blind segment 43 is created partly in the base 33*c* and partly in the stem 38; the calibrated restriction 53 and the segment 43*a* are created in the disc 33*b*.

According to a variant of FIG. 10 that is not shown, sections 44 are inclined like sections 59 shown in FIGS. 5 and 7.

According to a further variant of FIG. 10 that is not shown, sections 44 are made without special precision while the calibrated restriction is made in segment 43, similar to that shown for segment 66 in FIGS. 6 and 8.

Figure 11:
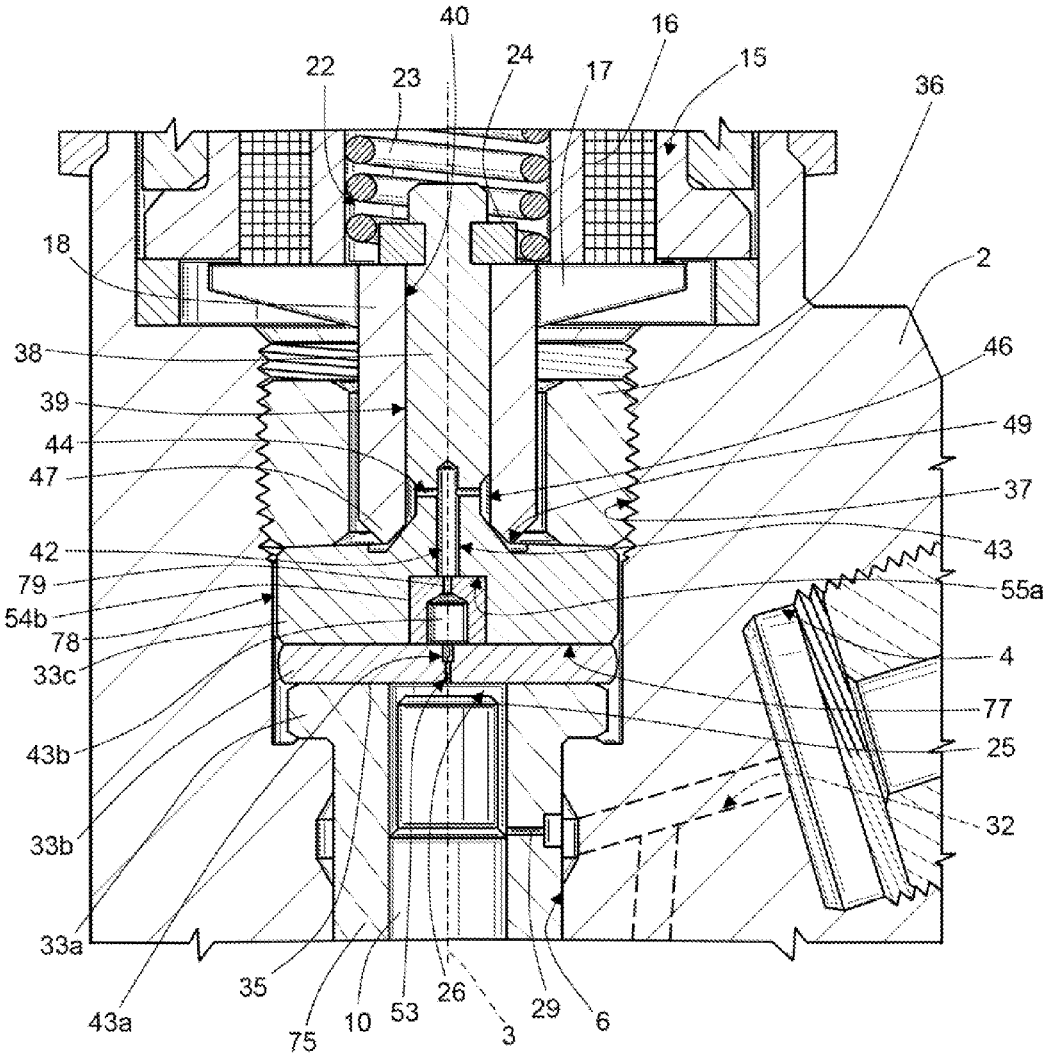
FIG. 11 is similar to FIG. 10 and shows a preferred embodiment of the fuel injector equipped with a metering servovalve for an internal combustion engine according to the present invention.

In the embodiment of FIG. 11, the body 76 is substituted by a body 78 that differs from body 76 because it comprises a seat 55*a* made in the flange 33*c* through the surface 77.

The segment 43 is coaxial with the seat 55*a* and runs directly into the seat 55*a*. The seat 55*a* has a larger diameter than that of segment 43, and is engaged by an insert defined by a cylindrical bushing 54*b*, which is interference fitted in the seat 55*b* and arranged flush with the surface 77 of the base 33*c*.

La bushing 54*b* defines a calibrated restriction 79, arranged in series with the restrictions 44 and 53. The restriction 79 only extends for part of the axial length of the bushing 54*b* and is in a position adjacent to segment 43. The remainder of the bushing 54*b* has an axial segment 43*b* with a larger diameter than that of the restrictions and communicating directly with segment 43*a*.

According to variants of FIG. 11 that are not shown, sections 44 are inclined like sections 59 in FIGS. 5 and 7; or sections 44 are made without special precision, while the calibrated restriction is made in segment 43, as in FIGS. 6 and 8.

Figure 12:
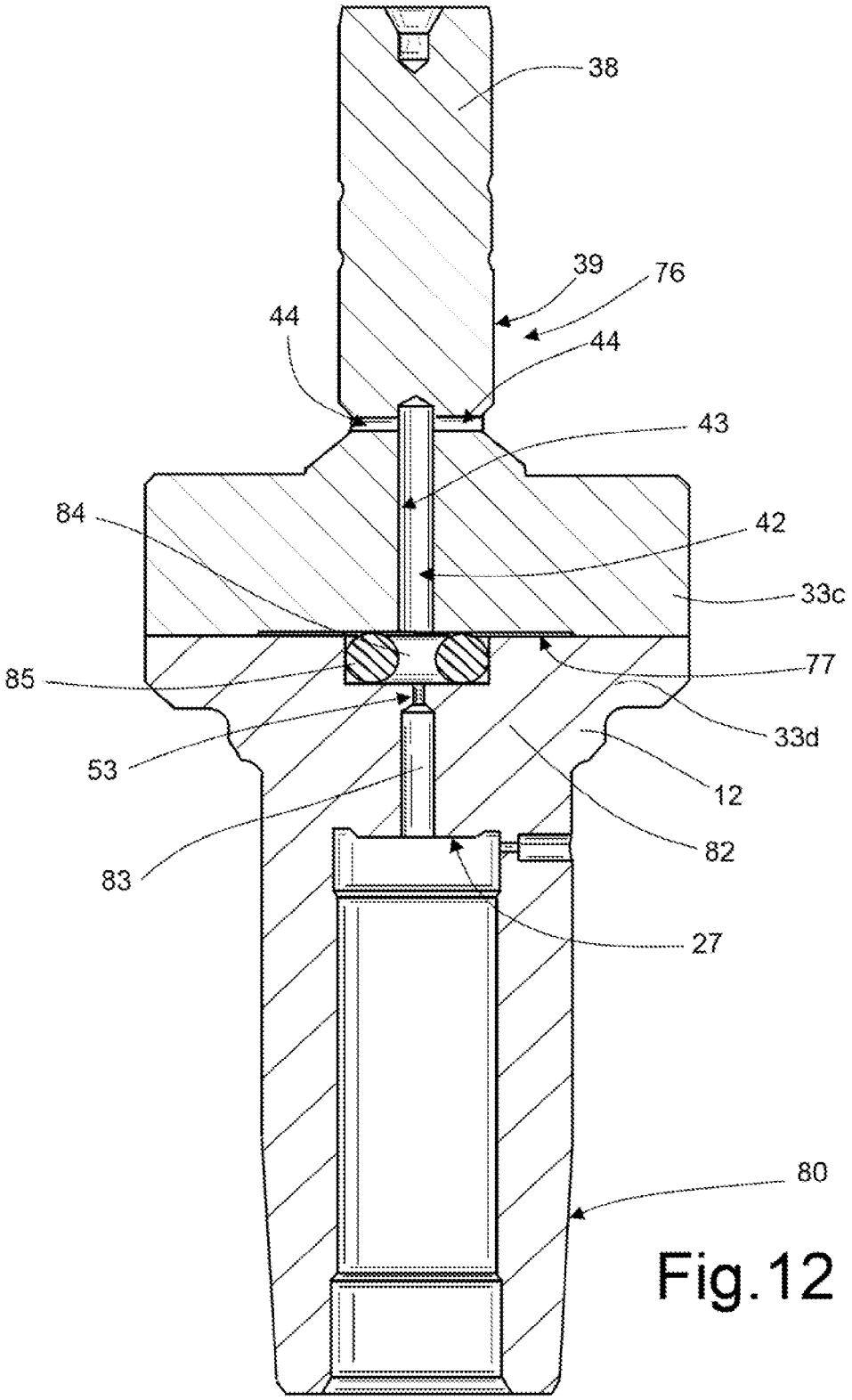
FIG. 12 is similar to FIG. 2 and shows another injector, which is not part of the present invention.

In the embodiment of FIG. 12, where possible, the components of the injector 1 are indicated by the same reference numerals used in FIG. 2. In this embodiment, the valve body 7 is substituted by two distinct pieces, one defined by the distribution body 76 in FIG. 10 and the other by a valve body 80.

The valve body 80 radially and axially delimits the control chamber 26 and comprises an end portion 82 provided with the ridge 12 and an external flange 33*d* axially secured between the flange 33*c* and the shoulder 35 (not shown).

The calibrated restriction 53 is made in portion 82 and runs into two coaxial sections 83 and 84 of the channel 42. The sections 83 and 84 have a larger diameter than that of the calibrated restriction 53 and substantially equal to that of segment 43. The segment 83 is defined by a hole in portion 82 and communicates directly with the control chamber 26; the segment 84 is defined by a sealing ring 85, which is housed in a seat 86 and arranged in contact against the surface 77 to define fluid-tight sealing of the channel 42 between the bodies 80 and 76. Alternatively, by opportunely reducing the diameter of segment 84, fluid sealing can still be achieved through metal-to-metal contact between the bodies 80 and 76 without any sealing ring.

According to variants of FIG. 12 that are not shown, the calibrated restriction 53 is obtained in an insert axially driven into the portion 80 from the side facing the control chamber 26, as in the solutions in FIGS. 1, 2, 3, 4 and 9, or from the side facing the base 33*c*. Moreover, as alternatives to the sections 44, the calibrated restriction of the body 76 is defined by inclined outlet sections like sections 59 in FIGS. 5 and 7, or by a blind axial segment like segment 66 in FIGS. 6 and 8.

According to further variants of FIG. 12, a third calibrated restriction is provided inside the body 76 or inside the valve body 80 and is arranged axially and in series between the calibrated restrictions 53 and 44.

Figure 13:
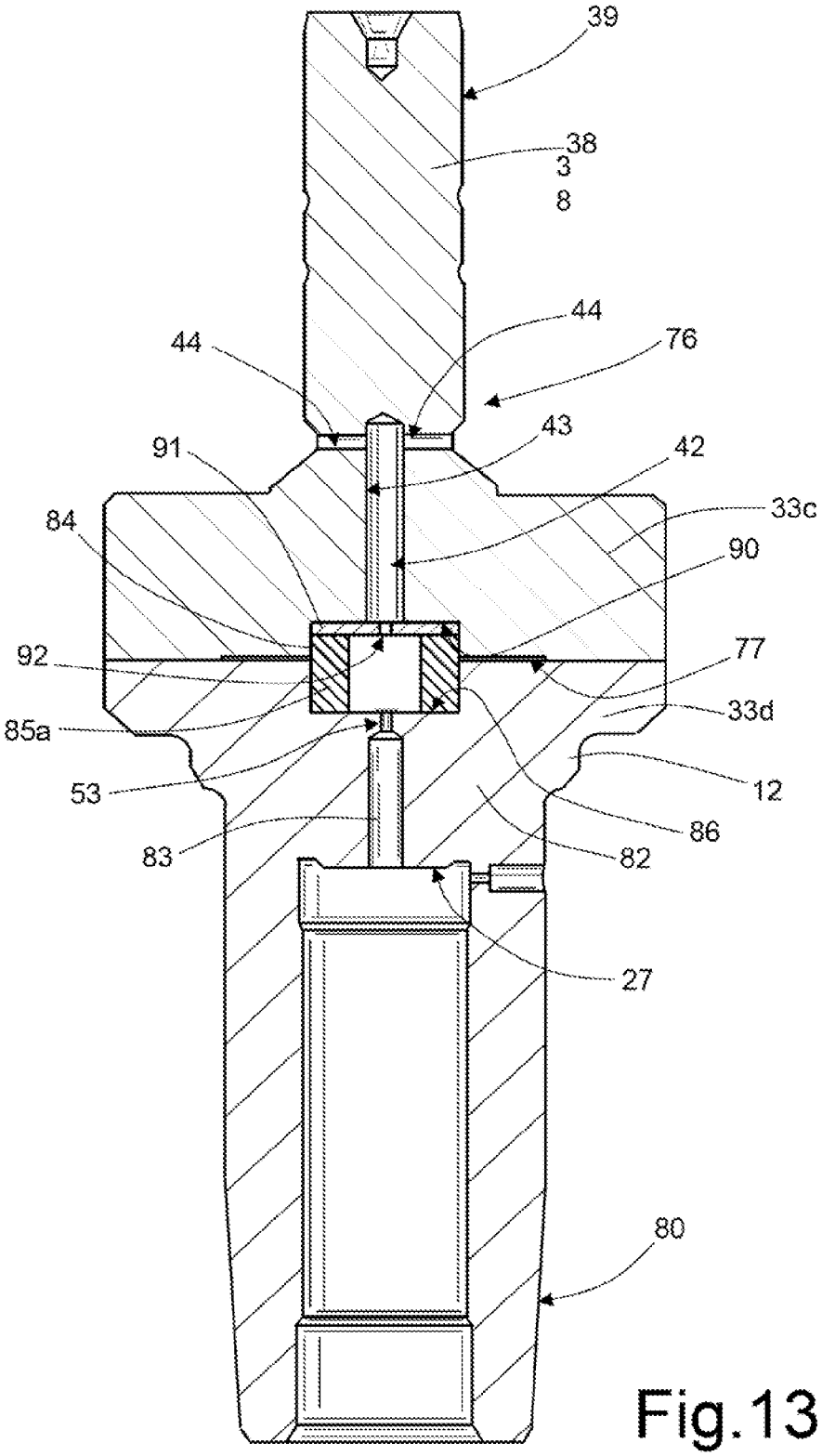
FIG. 13 shows a variant of the embodiment of FIG. 12.

One of these variants is shown in FIG. 13: the flange 33*c* has a circular seat 90, which is obtained along the surface 77 coaxially with the seat 86 and has the same diameter as the seat 86. The seat 90 houses a disc 91, which has an axial hole 92 defining the third calibrated restriction.

The disc 91 is kept in axial contact against the bottom of the seat 90 by a sealing ring 85*a*, provided in place of ring 85. The ring 85*a* has a rectangular or square cross-section, with an external diameter substantially equal to the diameter of the seats 90 and 86 and engages both of the seats 90 and 86 to define a centring member between the two bodies 80 and 76. In other words, the ring 85*a* provides three functions: axial centring between the bodies 80 and 76 when coupling, sealing between the bodies 80 and 76 around the fuel flow in the channel 42 and positioning of the disc 91 in the seat 90.

Figure 14:
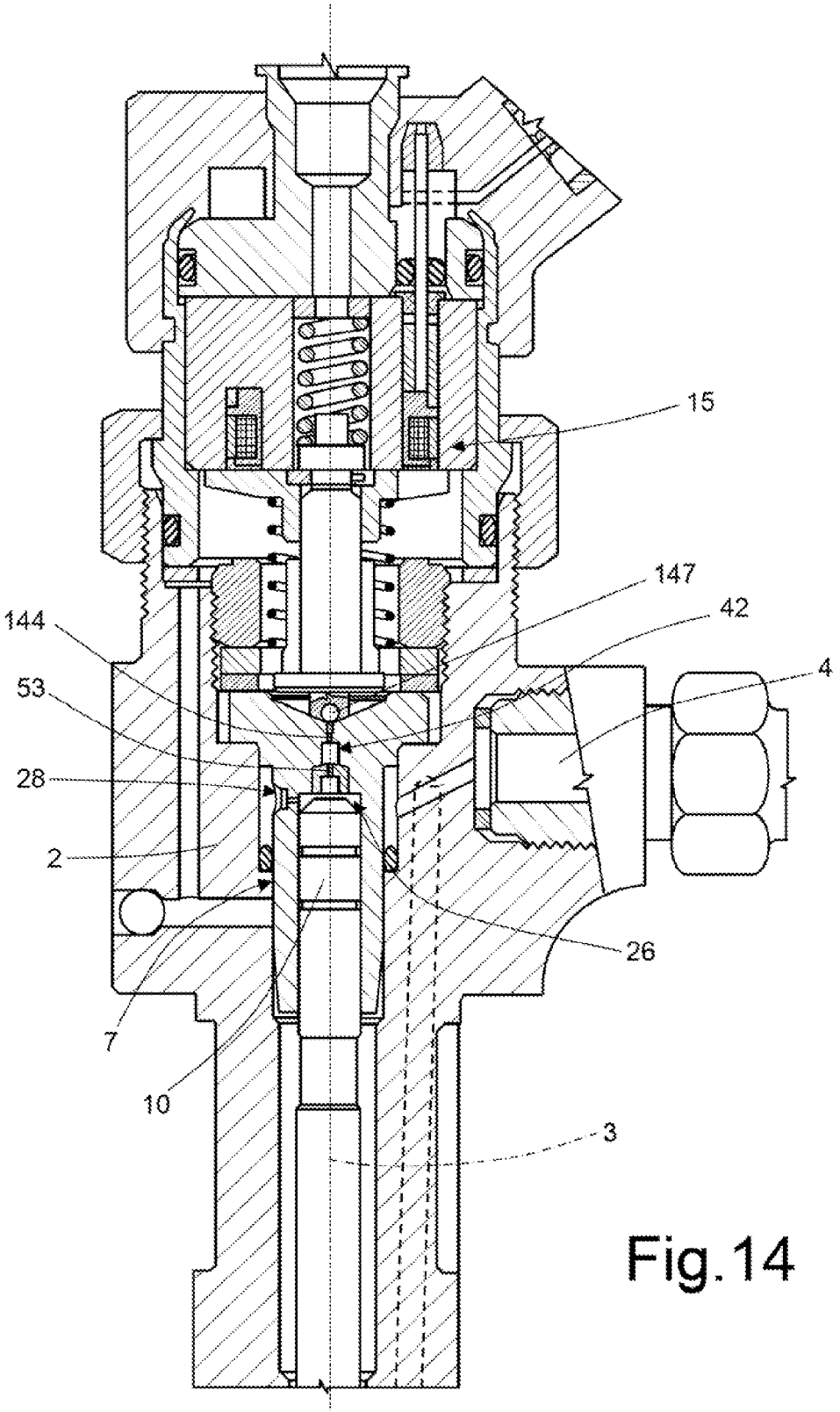
FIG. 14 is similar to FIG. 1 and shows another injector, which is not part of the present invention.
Figure 15:
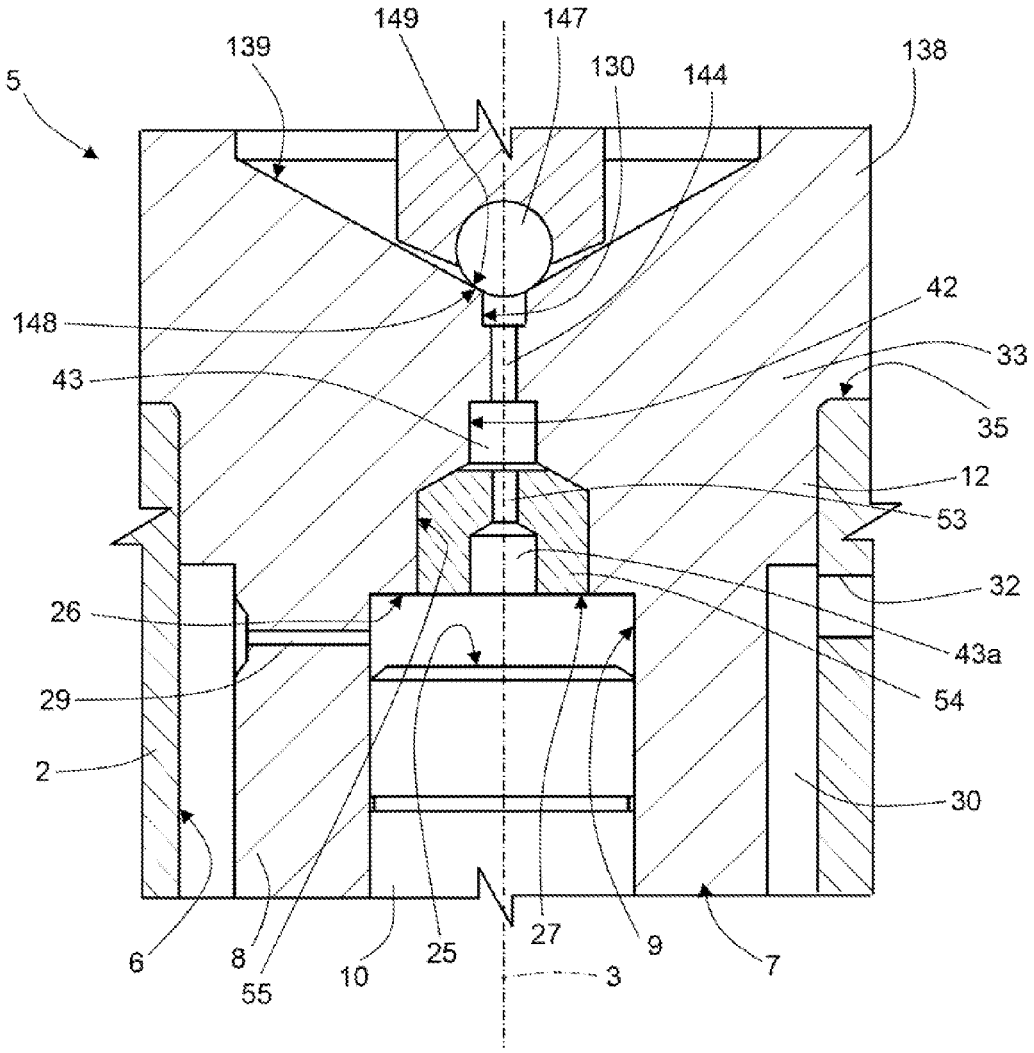
FIG. 15 shows a detail of FIG. 14, in an enlarged scale.

In the embodiment of FIGS. 14 and 15, where possible, the components of the injector 1 are indicated by the same reference numerals used in FIGS. 1 e 2.

The axial end of valve body 7, opposite to portion 8, has an axial recess 139, which is defined by a surface 149 having substantially a frustum of cone shape and houses a shutter 147.

The shutter 147 is axially movable in response to the action of the actuator 15 in a manner known and not described in detail, to open/close an axial outlet of the channel 42. The shutter 147 has a external spherical surface 148, which engages the surface 149 when the shutter 147 is located in its advanced end stop position or closure position, so as to define a sealing zone.

In a manner similar to the embodiment of FIGS. 1 and 2, the channel 42 comprises a restriction 53 made in an element that is separated from the valve body 7, in particular in the bushing 54 that is inserted in the seat 55 of the valve body 7 and is located flush with the bottom surface 27.

The axial segment 43 is made in the flange 33 and exits in an axial segment 144 of the channel 42. The segment 144 defines a calibrated restriction located in series and coaxial with the restriction 53. At the opposite end, the segment 144 exit in a final axial segment 130, which has a passage section larger than that of the segment 144 and defines the outlet of the channel 42 onto the surface 149.

In all the above described embodiments, the pressure drop, which, in use, occurs in the control chamber 26 and in the discharge channel when the shutter 47 is in the open position, is divided into as many pressure drops as there are calibrated restrictions arranged in series along the channel 42.

Figure 17:
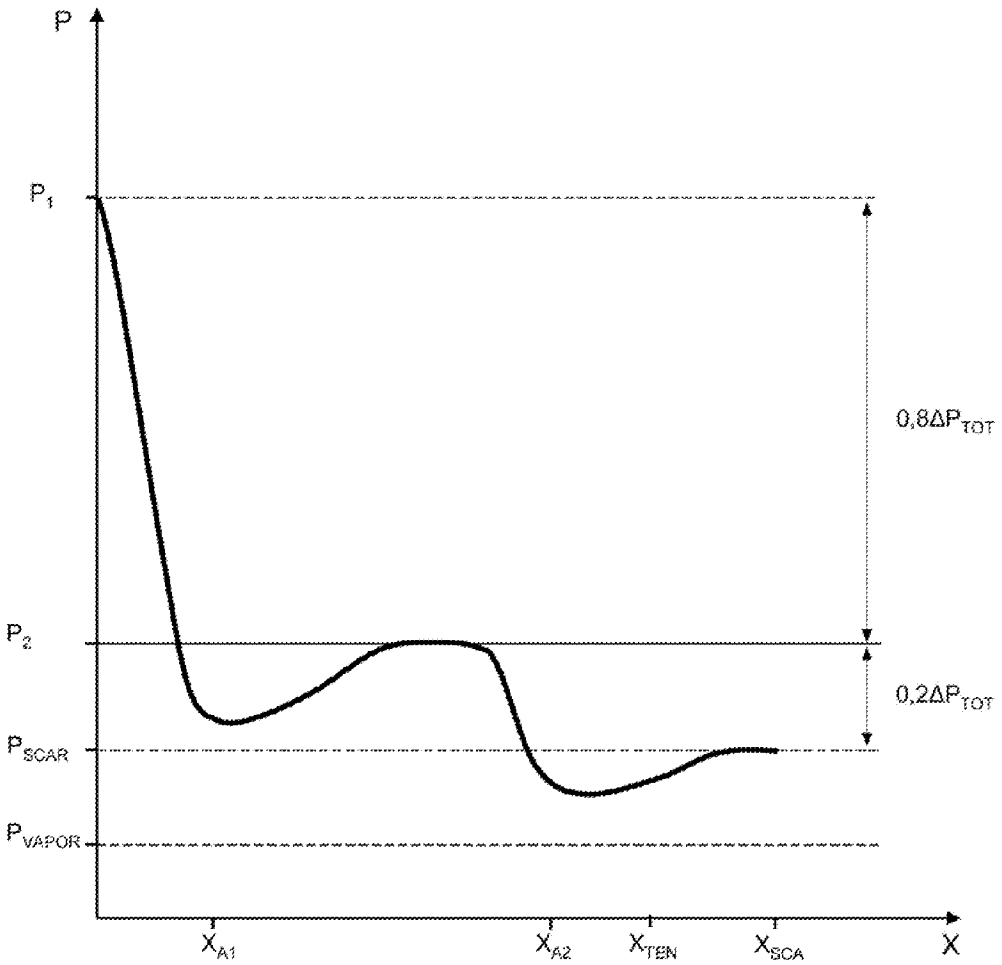
FIG. 17 is similar to FIG. 16 and shows the pressure trend of the injector in FIG. 1 when the metering servovalve is open.

Considering the two calibrated restrictions in series in FIG. 1, the experimental pressure trend of fuel leaving the control chamber 26 through the channel 42 is that qualitatively represented in FIG. 17. P indicates the pressure in the control chamber 26, $P_2$ indicates the pressure upstream of the second calibrated restriction, $P_{SCAR}$ indicates the pressure in the discharge environment, or rather downstream of the sealing zone, and $P_{VAPOR}$ indicates the vapour pressure.

The linearized distance along the channel 42 with respect to the chamber 26 is indicated on the abscissas. In particular:

- $X_{A1}$: position immediately downstream of the calibrated restriction 53,
- $X_{A2}$: intermediate position in one of the radial channels 44,
- $X_{TEN}$: position of seal between the surfaces 48 and 49,
- $X_{SCAR}$: position in which the pressure has stabilized at the discharge environment value.

Figure 16:
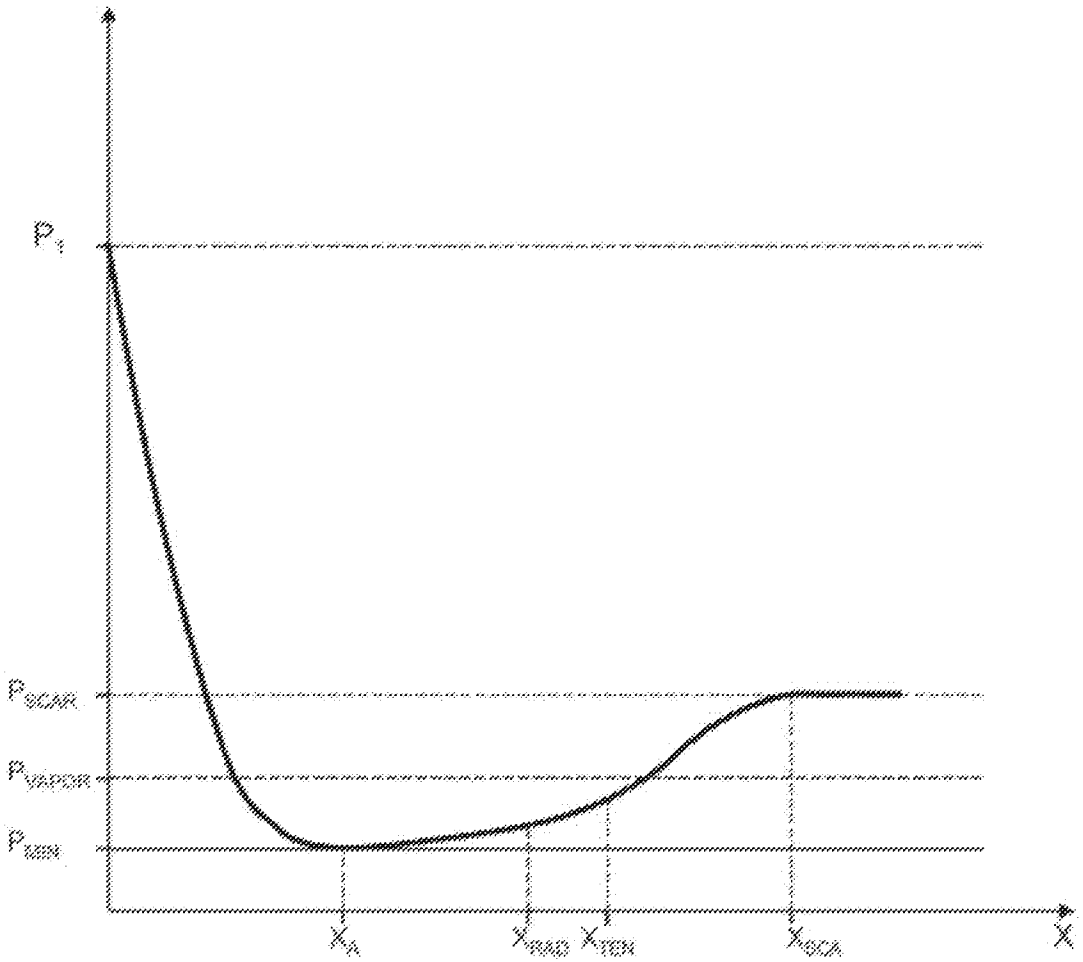
Fig.16 (Prior Art)
FIG. 16 shows the pressure trend of the outgoing fuel flow in an injector of known art in which a single calibrated segment is provided in the discharge channel when the metering servovalve is open.

Thanks to the sequence of calibrated restrictions, the pressure drop shown in FIG. 16 is divided into two successive pressure drops: by and large, the pressure does not drop below the vapour pressure $P_{VAPOR}$ and so cavitation phenomena, and therefore evaporation of the fuel flow, is avoided. The greater the number calibrated restrictions, the smaller the probability of cavitation occurring.

As mentioned above, for a hole defining a calibrated restriction, a close correlation exists between the flow rate passing through and the difference in pressure upstream and downstream of this hole.

$$Q = c_{effius} A_{foro} \sqrt{\frac{2\Delta p}{\rho}}$$

ρ=density of liquid, $c_{effius}$=velocity coefficient of hole (experimentally obtainable), $A_{foro}$=passage cross-section in hole, Δp=difference in pressure between upstream and downstream of hole, Q=flow rate.

Having a total number of n calibrated restrictions in series, which are crossed by the same flow rate Q, and assuming that the density of the fluid is constant and that cavitation is not present, gives:

$$Q = c_{effl_1} A_1 \sqrt{\frac{2\Delta p_1}{\rho}} \cong c_{effl_2} A_2 \sqrt{\frac{2\Delta p_2}{\rho}} \cong \ldots \cong c_{effl_n} A_n \sqrt{\frac{2\Delta p_n}{\rho}} \cong \cos t$$

Therefore, it is possible to write down a relation between the ratio of the pressure differences and the ratio of the passage sections. In fact, considering two restrictions indicated by subscripts 1 and 2, gives:

$$\frac{c_{effl1} A_1}{c_{effl_2} A_2} = \sqrt{\frac{\Delta p_2}{\Delta p_1}}$$

Assuming that the holes defining the restrictions are similar and consequently have the same velocity coefficient, gives:

$$\frac{A_1}{A_2} \approx \sqrt{\frac{\Delta p_2}{\Delta p_1}}$$

It is understood that in the case of restrictions with velocity coefficients significantly different from each other, the above formulas are valid, but must be completed with the values of these coefficients, determined experimentally.

In injector 1, the total pressure drop of the fuel flow from control chamber 26 to the discharge environment is known. Indicating this pressure drop as Δp0 and wishing to divide this pressure drop into two differentials Δp1 and Δp2 (with Δp0=Δp1+Δp2), gives:

$$\frac{c_{effl1} A_1}{c_{effl_0} A_0} = \sqrt{\frac{\Delta p_1 + \Delta p_2}{\Delta p_1}}$$

$$\frac{c_{effl2} A_2}{c_{effl_0} A_0} = \sqrt{\frac{\Delta p_1 + \Delta p_2}{\Delta p_2}}$$

where A0 and D0 are respectively the passage cross-section and the diameter of the hole that one would have if a single calibrated restriction were used, instead of having two restrictions in series defined by the subscripts 1 and 2.

In a first approximation, having set how to subdivide the differential Δp0 between the two holes or restrictions in series and the flow rate that must be made to flow from the control chamber 26, it is possible to obtain the value of the diameters D1 and D2.

The more the calibrated restrictions are distanced from the sealing zone defined by the surfaces 48 and 49, the greater the probability of avoiding the presence of vapour and cavitation in correspondence to this seal.

To reduce the risks of the presence of vapour to a minimum in correspondence to position $X_{TEN}$ (FIG. 17), it must be ensured that the pressure drop Δp1 associated with the first calibrated restriction is greater than the successive ones. Therefore, the first calibrated restriction (indicated by reference numeral 53 in FIGS. 1 to 13) will have a smaller passage section with respect to the successive calibrated restrictions.

The calibrated restriction 53 is associated with a pressure drop of at least 60% of the total pressure drop and, conveniently, at least 80%.

For example, wishing to subdivide the pressure drop Δp0 in a way to associate 80% of this drop with the first restriction and 20% with the second restriction (Δp2=0.2 Δp0), and also assuming that the velocity coefficients are equal, a first approximation gives:

$$\frac{D_1}{D_0} \approx \left(\frac{\Delta p_0}{0{,}8\Delta p_0}\right)^{0{,}25} \approx 1{,}06$$

$$\frac{D_2}{D_0} \approx \left(\frac{\Delta p_0}{0{,}2\Delta p_0}\right)^{0{,}25} \approx 1{,}49$$

Therefore:

$$\frac{D_2}{D_1} \approx \left(\frac{\Delta p_1}{\Delta p_2}\right)^{0.25} \approx 1{,}41$$

$$\frac{A_2}{A_1} \approx \sqrt{\frac{\Delta p_1}{\Delta p_2}} \approx 2$$

Generalizing the example shown above gives:

$$1<(D2/D1)<=2.088$$

or $$1<(A2/A1)<=4.36$$

In particular, the condition D2/D1=1 corresponds to the case in which Δp1=Δp2=(0.5 Δp0).

Instead, the condition D2/D1=2.088 and A2/A1=4.36 corresponds to the case in which Δp1=(0.95 Δp0) and Δp2=(0.05 Δp0) (or Δp1/Δp2=19).

As explained above, the passage sections of the calibrated restrictions (A1 and A2) are easily calculated after having established the subdivision of the pressure drop Δp0 at design level and having set the flow rate Q with which it is wished to discharge the control chamber 26 in order to achieve certain performance levels from the injector (the desired flow rate Q determines the passage section A0 that one would have in the case of a single restriction to achieve the pressure drop Δp0).

According to the invention, considering the embodiment of FIG. 11, the pressure drop Δp0 is subdivided into three parts (Δp1+Δp2+Δp3). In particular:

$$\frac{c_{eff1}A_1}{c_{eff0}A_0} = \sqrt{\frac{\Delta p_1 + \Delta p_2 + \Delta p3}{\Delta p_1}}$$

$$\frac{c_{eff2}A_2}{c_{eff0}A_0} = \sqrt{\frac{\Delta p_1 + \Delta p_2 + \Delta p3}{\Delta p_2}}$$

$$\frac{c_{eff3}A_3}{c_{eff0}A_0} = \sqrt{\frac{\Delta p_1 + \Delta p_2 + \Delta p3}{\Delta p_3}}$$

Considering the embodiment of FIG. 1, the second restriction is subdivided into a plurality m of radial sections 44, all having the same diameter $d_{fororad}$ and the same passage section $A_{fororad}$.

Noting that the radial sections are mutually parallel and thus associated with the same pressure drop, simply gives:

$$A_2 = mA_{fororad} = m\frac{\pi}{4}d^2_{fororad}$$

from which the diameter $d_{fororad}$ of each radial segment is obtained.

From what explained above, it emerges that the volumes of the channel 42, which are arranged in intermediate positions between the calibrated restrictions, have a pressure that is predetermined and a consequence of the pressure drops Δp1, Δp2, etc. set in the design and manufacturing phase.

Subdividing the total pressure drop into a number of parts reduces the risks of vapour being present, because the fuel's flow velocity in correspondence to the last pressure drop is relatively low. The risks of having local pressure values lower than the fuel's vapour pressure are thus limited: the vapour fraction in the sealing zone, if present, would in any case be much lower with respect to the situation with a single calibrated restriction.

By splitting the pressure drop in order to have the largest part—90% of the entire pressure drop for example—associated with the first restriction (calibrated restriction 53), the formation of vapour and possible cavitation, due to recompression downstream of the restrictions, could possibly occur in proximity to this first calibrated restriction, but would not influence the life of the injector 1, as the phenomena would be relatively distant from the sealing zone between the shutter 47 and the stem 38.

Given that the second restriction is associated with a smaller pressure drop and therefore has larger diameters than the first restriction, the second restriction is easier to make. From the constructional viewpoint, only the first calibrated restriction requires special accuracy. In fact, as the second restriction is associated with a relatively small pressure drop, any dimensional manufacturing errors do not cause particularly adverse effects: in other words, the pressure drop of the second restriction is less sensitive to possible dimensional manufacturing errors.

Embodiments in which it is possible to reduce the diameter of the stem 38 and, in consequence, the sealing diameter of the shutter 47, with consequent reduction in leakage under dynamic conditions, and consequent reduction in the preloading required for the spring 23 and the force required of the actuator 15, are particularly useful.

In particular, the diameter of the stem 38 can be reduced to a value between 2.5 and 3.5 mm, according to the material chosen for the valve body, the heat treatment to which the valve body is subjected and, consequently, its toughness, and lastly, the manufacturing cycle adopted.

The reduction of the seal diameter on the shutter 47 also allows the axial length of the sleeve 18 to be reduced.

In fact, the flow rate of fluid leakage is directly proportional to the circumference of the coupling zone between the inner cylindrical surface of the sleeve 18 and the outer cylindrical surface 39 of the stem 38, but inversely proportional to the axial length of this coupling zone: as the circumference of the coupling zone has decreased, for the same fluid leakage flow rate it is possible to reduce the axial length of the coupling zone and, consequently, the axial length of the sleeve 18.

The reduction of the seal diameter and, in consequence, the external diameter of the shutter 47 and the reduction in length of the sleeve 18 have the effect of reducing the mass of the sleeve 18 and, consequently, the response times of the metering servovalve 5.

Furthermore, the reduction in the seal diameter allows the load of the spring 23 to be reduced: in fact, for the same coupling play between the stem 38 and the shutter 47, the circumference of the seal between the stem 38 and the shutter 47 decreases and, consequently, also the axial force that acts on the shutter 47 due to the fuel pressure, which although minimal, is still present even if the metering servovalve of the FIGS. 1-13 is of the balanced type. The ratio between the preloading of the spring 23 and the seal diameter or diameter of the coupling zone is usefully between 8 and 12 (N/mm).

The reduction in mass of the sleeve 18 and the reduction in load of the spring 23 have the effect of much smaller rebounds by the shutter 47 in the closure phase, and therefore better operating precision of the metering servovalve 5.

Finally, it is clear that modifications and variants can be made regarding the injector 1 described herein without leaving the scope of protection of the present invention, as defined in the attached claims.

In particular, the balanced-type metering servovalve 5 of the FIGS. 1-13 could comprise a shutter defined by an axial pin sliding in a fixed sleeve with respect to the casing 2 and defining the final part of the channel 42. An adjustment spacer could be provided between the bodies 76 and 80 in the embodiment of FIG. 12, even if extra finishing and surface hardening work would be required in this case.

The actuator 15 could be substituted by a piezoelectric actuator that, when subjected to an electric current, increases its axial dimension to operate the sleeve 18 in order to open the outlet of the channel 42.

Moreover, the chamber 46 could be at least partially excavated in the surface 40, but always with a shape such that the shutter 47 defined by the sleeve 18 is subject to a null pressure resultant along the axis 3 when it is positioned in the closure end stop position.

The axes of the sections 44 could lie on mutually different planes, and/or could not all be equally distanced around the axis 3, and/or the calibrated holes could be limited to just a part of the sections 44.

The channel 42 could be asymmetric with respect to the axis 3; for example, the sections 44 could have mutually different cross-sections and/or diameters, but always calibrated to generate an opportune pressure drop to cause a flow rate of discharged fuel that is balanced around the axis 3 and constant over time.

The invention claimed is:

1. A fuel injector for an internal combustion engine, the injector ending with a nozzle to inject fuel into an associated engine cylinder and comprising:

a hollow injector body extending along an axial direction;

a metering servovalve housed in said injector body and comprising:

an electro-actuator;

a control chamber communicating with a fuel inlet and with a fuel discharge channel, the pressure in said control chamber controlling the opening/closing of said nozzle;

a shutter axially movable in response to the action of said electro-actuator between a closed position, in which an outlet of said discharge channel is closed, and an open position, in which the discharge channel is open, to vary the pressure in said control chamber;

wherein said discharge channel comprises three restrictions having calibrated passage sections and arranged in series with each other so as to cause respective pressure drops when said discharge channel is open, said calibrated passage sections of each of the three calibrated restrictions restricting fuel flow in both directions, said restrictions spaced apart from one another by enlarged intermediate segments of the discharge channel that extend between adjacent ones of the restrictions, each of said enlarged intermediate segments having a cross-sectional area that is larger than a cross-sectional area of the restrictions that it extends between;

wherein said restrictions are defined by respective bodies that are distinct from each other.

2. The injector according to claim 1, wherein two of said calibrated restrictions are arranged along said axial direction.

3. The injector according to claim 1, wherein said discharge channel is in a fixed position with respect to the injector body.

4. The injector according to claim 1, wherein a first body is housed in a second body.

5. The injector according to claim 4, wherein the first body is defined by an insert coupled to the second body by interference fitting.

6. The injector according to claim 5, wherein said insert is arranged along said axial direction.

7. The injector according to claim 1, wherein the first body is defined by a plate arranged in axial contact against the second body and axially delimiting said control chamber on one side.

8. The injector according to claim 3, further comprising a stem located in a fixed position with respect to said injector body and having a lateral surface which guides said shutter between said open and closed positions; said discharge channel defining an outlet opening located onto said lateral surface in a position so as to cause a substantially null axial force resultant due to the fuel when said shutter is located in its closed position.

9. The injector according to claim 8, wherein said stem is defined by a substantially cylindrical protrusion, and said shutter is defined by a sleeve.

10. The injector according to claim 8, wherein, considering the direction of the flow exiting from said control chamber into said discharge channel, the last of said restrictions is made in said stem.

11. The injector according to claim 2, further comprising: a tubular portion of the hollow injector body radially delimiting said control chamber; wherein a stem defines part of a piece distinct from said tubular portion of the hollow injector body; and wherein said three calibrated restrictions are made, respectively: in said piece; in an insert housed in said piece; and in a disc arranged in axial contact against said piece on one side and, on the other side, against said tubular portion of the hollow injector body.

12. The injector according to claim 10, wherein the last of said restrictions is obtained in at least one straight outlet segment that exits through said lateral surface.

13. The injector according to claim 12, wherein said straight outlet segment is inclined with respect to said axis by an angle other than 90°.

14. The injector according to claim 13, wherein the angle of inclination of said straight outlet segment with respect to said axis is between 30° and 45°.

15. The injector according claim 1, wherein, considering the direction of the flow exiting from said control chamber into said discharge channel, the first of said restrictions is associated with a pressure drop greater than the pressure drops to which the successive restrictions are associated.

* * * * *